US011067040B2

(12) United States Patent
Son et al.

(10) Patent No.: US 11,067,040 B2
(45) Date of Patent: Jul. 20, 2021

(54) EXHAUST GAS COOLING APPARATUS

(71) Applicant: Hanon Systems, Daejeon (KR)

(72) Inventors: Jung Wook Son, Daejeon (KR); Sang Jun Lee, Daejeon (KR); Yang Woo Lee, Daejeon (KR); Tae Soo Chun, Daejeon (KR); Hyeon Geun Chae, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 16/486,337

(22) PCT Filed: Apr. 12, 2018

(86) PCT No.: PCT/KR2018/004297
§ 371 (c)(1),
(2) Date: Aug. 15, 2019

(87) PCT Pub. No.: WO2018/230826
PCT Pub. Date: Dec. 20, 2018

(65) Prior Publication Data

US 2020/0102917 A1 Apr. 2, 2020

(30) Foreign Application Priority Data

Jun. 14, 2017 (KR) ..... 10-2017-0074548

(51) Int. Cl.
*F02M 26/28* (2016.01)
*F02M 26/32* (2016.01)

(52) U.S. Cl.
CPC ..... *F02M 26/28* (2016.02); *F02M 26/32* (2016.02)

(58) Field of Classification Search
CPC F28D 21/00; F28F 3/06; F02M 26/28; F02M 26/32
See application file for complete search history.

(56) References Cited

U.S. PATENT DOCUMENTS

2003/0201094 A1 10/2003 Evans et al.
2015/0027673 A1* 1/2015 De Francisco Moreno ..... F28F 9/026 165/159
2017/0152816 A1* 6/2017 Ohrem ..... F02M 26/32
(Continued)

FOREIGN PATENT DOCUMENTS

KR 10-0748756 B1 8/2007
KR 10-2017-0011151 A 2/2017
KR 10-2017-0037003 A 4/2017
(Continued)

*Primary Examiner* — Sizo B Vilakazi
(74) *Attorney, Agent, or Firm* — Norton Rose Fulbright US LLP; James R. Crawford

(57) ABSTRACT

The present invention relates to an exhaust gas cooling apparatus and, more specifically, to an exhaust gas cooling apparatus capable of reducing flow resistance and improving heat exchange performance, the apparatus comprising: a plurality of heat exchange tubes (200), which is spaced apart from each other by a predetermined distance in the width direction and has a height longer than the width, and through which an exhaust gas flows; and a main plate (300) including a first communication hole (310) to which one end of each of the heat exchange tubes (200) is fixed and a second communication hole (320) to which the other end of each of the heat exchange tubes (200) is fixed.

8 Claims, 9 Drawing Sheets

(56) References Cited

U.S. PATENT DOCUMENTS

| | | | | |
|---|---|---|---|---|
| 2017/0370329 | A1* | 12/2017 | Chun | F28F 1/02 |
| 2020/0309071 | A1* | 10/2020 | Onkarachari | F02B 29/045 |

FOREIGN PATENT DOCUMENTS

| | | | | |
|---|---|---|---|---|
| KR | 20170037003 | A | * | 4/2017 |
| KR | 10-2017-0048022 | A | | 5/2017 |
| KR | 20170047997 | B1 | | 5/2017 |
| KR | 20170048022 | A | * | 5/2017 |
| KR | 10-2017-0062411 | A | | 6/2017 |

* cited by examiner

EXHAUST GAS COOLING APPARATUS

This application is a national phase under 35 U.S.C. § 371 of International Application No. PCT/KR2018/004297 filed Apr. 12, 2018, which claims the benefit of priority from Korean Patent Application No. 10-2017-0074548 filed on Jun. 14, 2017, which is hereby incorporated by reference in its entirety.

TECHNICAL FIELD

The present invention relates to an exhaust gas cooling apparatus, and more particularly, to a heat exchanger used in an exhaust gas recirculation (EGR) cooler for lowering a temperature of an exhaust gas or an exhaust heat recovering apparatus for recovering heat of a high temperature exhaust gas that is formed to reduce flow resistance and improve a heat exchange performance.

BACKGROUND ART

In general, exhaust gas of automobiles contains a large amount of harmful substances such as carbon monoxide, nitrogen oxide, hydrocarbon, and the like. In particular, the higher a temperature of an engine, the higher an emission amount of harmful substance such as nitrogen oxide.

These days, exhaust gas regulations have been strengthened in each country. In order to satisfy the exhaust gas regulations strengthened for each country, various devices are installed in the vehicle to reduce the harmful substances such as nitrogen oxide in the exhaust gas.

In particular, in the case of a vehicle equipped with a diesel engine, as components of the burned fuel are different from those of a vehicle equipped with a gasoline engine, an apparatus such as a diesel particulate filter (DPF) or an exhaust gas recirculation (EGR) is equipped and is used to satisfy the exhaust gas regulations by reducing harmful exhaust gas such as nitrogen oxide.

In general, the DPF collects particulate matter (PM) contained in the exhaust gas by a filter and then injects fuel into an exhaust pipe at the front end of the filter to forcibly burn the particulate matter, thereby reducing the exhaust gas and regenerating the filter.

The EGR performs a function of reducing the emission of the harmful substance such as nitrogen oxide and sulfur oxide by lowering a temperature of a combustion chamber by sucking a part of the exhaust gas of the vehicle together with a mixer.

In addition, nowadays, an EGR cooler is applied as well to lower a temperature of EGR gas by strengthening regulations on atmospheric environment pollution around the world. The exhaust gas flowing into the EGR cooler is cooled by a coolant (cooling fluid) discharged through the engine.

A related technology is disclosed in Korean Patent No. 0748756.

A conventional EGR cooler has a structure including a cooler body with a coolant inflow pipe and a coolant outflow pipe at both ends thereof, and a plurality of gas tubes arranged in the cooler body in parallel along a length direction, wherein a reed valve is provided at one side of the cooler body.

Therefore, high temperature exhaust gas may be cooled by a circulation system in which the coolant supplied through the coolant inflow pipe is heat-exchanged with the exhaust gas flowing through the gas tube in the cooler body, and the heat-exchanged coolant is discharged through the coolant outflow pipe.

Meanwhile, an exhaust heat recovery apparatus for a vehicle is an apparatus for recovering exhaust heat that is discarded after engine combustion to use the exhaust heat for warming up of the engine and warming up of a transmission at an initial cold start of the vehicle, or transferring the recovered heat energy to an air conditioning apparatus to utilize the recovered heat energy for indoor heating of the vehicle.

That is, when the exhaust heat recovery apparatus is used, the coolant may be heated by using the high temperature exhaust gas at the beginning of the start, and accordingly, there is an advantage that a preheating time of the engine may be shortened to improve fuel efficiency and reduce the exhaust gas.

In addition, pollutants discharged from the vehicle are mostly discharged during idling before the engine is warmed up, and the pollutants discharged from the vehicle may also be reduced by shortening a warm-up time using the exhaust heat recovery apparatus.

Further, the coolant heated by the exhaust heat recovery apparatus rapidly raises the temperature of an engine coolant and a transmission oil to reduce friction inside the engine and the transmission, thereby effectively improving the fuel efficiency and achieving an effect of fast indoor heating in winter.

In particular, in the exhaust heat recovery apparatus, a heat exchanger that performs a heat exchange between the coolant and the exhaust gas greatly affects a performance of the exhaust heat recovery apparatus.

However, the conventional EGR cooler or the exhaust heat recovery apparatus has a disadvantage that a shape and an arrangement structure of the heat exchange tube are formed with a large flow resistance and the heat exchange performance is low. In addition, there is a problem in that the structure thereof is complicated and an assembly and a mass production are difficult.

DISCLOSURE

Technical Problem

An object of the present invention is to provide an exhaust gas cooling apparatus capable of reducing flow resistance within a limited space and improving a heat exchange performance.

Technical Solution

In one general aspect, an exhaust gas cooling apparatus includes: a plurality of heat exchange tubes 200 disposed to be spaced apart from each other by a predetermined interval in a width direction, having a height longer than a width, and including an exhaust gas flowing therein; and a main plate 300 including a first communication hole 310 to which one end of each of the heat exchange tubes 200 is fixed and a second communication hole 320 to which the other end of each of the heat exchange tubes 200 is fixed.

The heat exchange tubes 200 may include a first side surface 210 perpendicular to a width direction; a second side surface 250 having the same shape as the first side surface 210 and disposed to be spaced apart from the first side surface 210 by a predetermined interval; and a connection surface 290 formed by connecting peripheries except for portions contacting the first communication hole 310 and the second communication hole 320 among peripheries of the first side surface 210 and the second side surface 250.

The heat exchange tubes 200 may include a first surface portion 211 including a first bonding portion 215 that protrudes toward a second side surface 250 by a predetermined length in a periphery except for portions inserted into the first communication hole 310 and the second communication hole 320 among a first side surface 210 perpendicular to a width direction and a periphery of the first side surface 210; and a second surface portion 251 including a second bonding portion 255 that protrudes toward the first side surface 210 by a predetermined length in a periphery except for the portions inserted into the first communication hole 310 and the second communication hole 320 among a second side surface 250 perpendicular to the width direction and a periphery of the second side surface 250, and a side surface of the second bonding portion 255 and a side surface of the first bonding portion 215 may be disposed to be in contact with each other such that an exhaust gas flow path may be formed between the first surface portion 211 and the second surface portion 251.

The first side surface 210 may include a first flat portion 220 extending along a length direction; a 1-1-th curve portion 230 extending from one end of the first flat portion 220 to the first communication hole 310; and a 1-2-th curve portion 240 extending from the other end of the first flat portion 220 to the second communication hole 320, and the second side surface 250 may include a second flat portion 260 extending along the length direction; a 2-1-th curve portion 270 extending from one end of the second flat portion 260 to the first communication hole 310; and a 2-2-th curve portion 280 extending from the other end of the second flat portion 260 to the second communication hole 320.

The first side surface 210 may include a plurality of first protrusions 225 protruding in a direction opposite to the second side surface 250, and the second side surface 250 may include a plurality of second protrusions 265 protruding in a direction opposite to the first side surface 210.

An end portion of the first protrusion 225 may be disposed to be in contact with an end portion of the second protrusion 265 of an adjacent heat exchange tube 200 so that the cooling fluid may flow between the first side surface 210 and the second side surface 250 of the adjacent heat exchange tube 200.

An end portion of the 1-1-th curve portion 230 which is in contact with the first communication hole 310 may protrude in the same manner as the first protrusion 225, an end portion of the 1-2-th curve portion 240 which is in contact with the first communication hole 310 may protrude in the same manner as the second protrusion 265, an end portion of the 2-1-th curve portion 270 which is in contact with the second communication hole 320 may protrude in the same manner as the first protrusion 225, and an end portion of the 2-2-th curve portion 280 which is in contact with the second communication hole 320 may protrude in the same manner as the second protrusion 265, and the end portion of the 1-1-th curve portion 230 may be disposed to be in contact with the end portion of the 2-1-th curve portion 270 of an adjacent heat exchange tube 200, and the end portion of the 1-2-th curve portion 240 may be disposed to be in contact with the end portion of the 2-2-th curve portion 280 of an adjacent heat exchange tube 200.

The first bonding portion 215 or the second bonding portion 255 may protrude as much as a width of an exhaust gas flow path.

The first communication hole 310 may include a plurality of holes to which one end of each of the heat exchange tubes 200 is inserted and fixed, and the second communication hole 320 may include a plurality of holes to which the other end of each of the heat exchange tubes 200 is inserted and fixed.

A heat radiating fin 600 may be provided between the first side surface 210 and the second side surface 250.

The exhaust gas cooling apparatus may further include an exhaust gas inflow portion 410 having one side coupled to the first communication hole 310 and the other side through which the exhaust gas is introduced; and an exhaust gas outflow portion 420 having one side coupled to the second communication hole 320 and the other side to which the exhaust gas is discharged.

The exhaust gas cooling apparatus may further include a housing 100 formed to correspond to an outer wall surface of a cylinder block 10 positioned outside a water jacket 11 of an internal combustion engine mounted in a vehicle and disposed on the outer wall surface of the cylinder block 10, and including a cooling fluid inlet 110 and a cooling fluid outlet 120, wherein the main plate 300 is mounted in the housing 100 to dispose the heat exchange tubes 200 in the housing 100 and the cooling fluid flows outside the heat exchange tubes 200.

The exhaust gas cooling apparatus may further include a housing 100 provided on an exhaust gas discharging line, and including a cooling fluid inlet 110 and a cooling fluid outlet 120 which are formed in an upper portion of the housing 100, and an exhaust gas inlet 710 and an exhaust gas outlet 720 which are formed in a lower portion of the housing 100, wherein the main plate 300 is mounted in the housing 100 so that the cooling fluid flows above the main plate 300 on which the heat exchange tubes 200 are disposed and the exhaust gas flows below the main plate 300.

Advantageous Effects

Accordingly, the exhaust gas cooling apparatus according to the present invention includes the plurality of heat exchange tubes 200 having the height longer than the width, thereby reducing the flow resistance of the cooling fluid.

In addition, the length of the first flat portion 220 is formed to be longer than the heights of the 1-1-th curve portion 230 and the 1-2-th curve portion 240, thereby making it possible to entirely reduce the flow resistance and increase the heat exchange area to maximize the heat exchange performance.

In addition, turbulence may occur in the cooling fluid flowing on the outer surface of the heat exchange tube 200 by forming the first protrusion 225 and the second protrusion 265, thereby improving the heat exchange performance.

In addition, since the portions that are in contact with the communication holes in the first protrusion 225, the second protrusion 265, and the 1-1-th curve portion 230 to the 2-2-th curve portion 280 protrude, it is not necessary to form separate holes in the main plate 300 and the assembly may be performed so that the exhaust gas does not leak to the outside.

In addition, the plurality of heat exchange tubes 200 including the first surface portion 211 and the second surface portion 251, the heat radiating fin 600, and the main plate 300 may be simultaneously brazed to facilitate the assembly and the mass production.

[Description of reference numerals]

| | |
|---|---|
| 1: exhaust gas cooling apparatus | |
| 10: cylinder block | 11: water jacket |
| 100: housing | |
| 110: cooling fluid inlet | 120: cooling fluid outlet |
| 200: heat exchange tube | 210: first side surface |
| 211: first surface portion | 215: first bonding portion |
| 220: first flat portion | 225: first protrusion |
| 230: 1-1-th curve portion | 240: 1-2-th curve portion |
| 250: second side surface | 251: second surface portion |
| 255: second bonding portion | 260: second flat portion |
| 265: second protrusion | 270: 2-1-th curve portion |
| 280: 2-2-th curve portion | 290: connection surface |
| 300: main plate | |
| 310: first communication hole | 320: second communication hole |
| 410: exhaust gas inflow portion | 420: exhaust gas outflow portion |
| 500: gasket | |
| 600: heat radiating fin | |
| 700: exhaust gas discharging line | |
| 710: exhaust gas inlet | 720: exhaust gas outlet |

BEST MODE

Hereinafter, an exhaust gas cooling apparatus according to the present invention will be described in detail with reference to the accompanying drawings.

An exhaust gas cooling apparatus 1 according to the present invention may be applied to a heat exchanger using exhaust gas such as an EGR cooler for lowering a temperature of the exhaust gas or an exhaust gas recovery apparatus for recovering heat of a high temperature exhaust gas. For explanation, as a first exemplary embodiment of the present invention, an exhaust gas cooling apparatus that may be applied to the EGR cooler will be described, and as a second exemplary embodiment of the present invention, an exhaust gas cooling apparatus that may be applied to a heat exchanger used in the exhaust heat recovery apparatus will be described.

Figure 1:
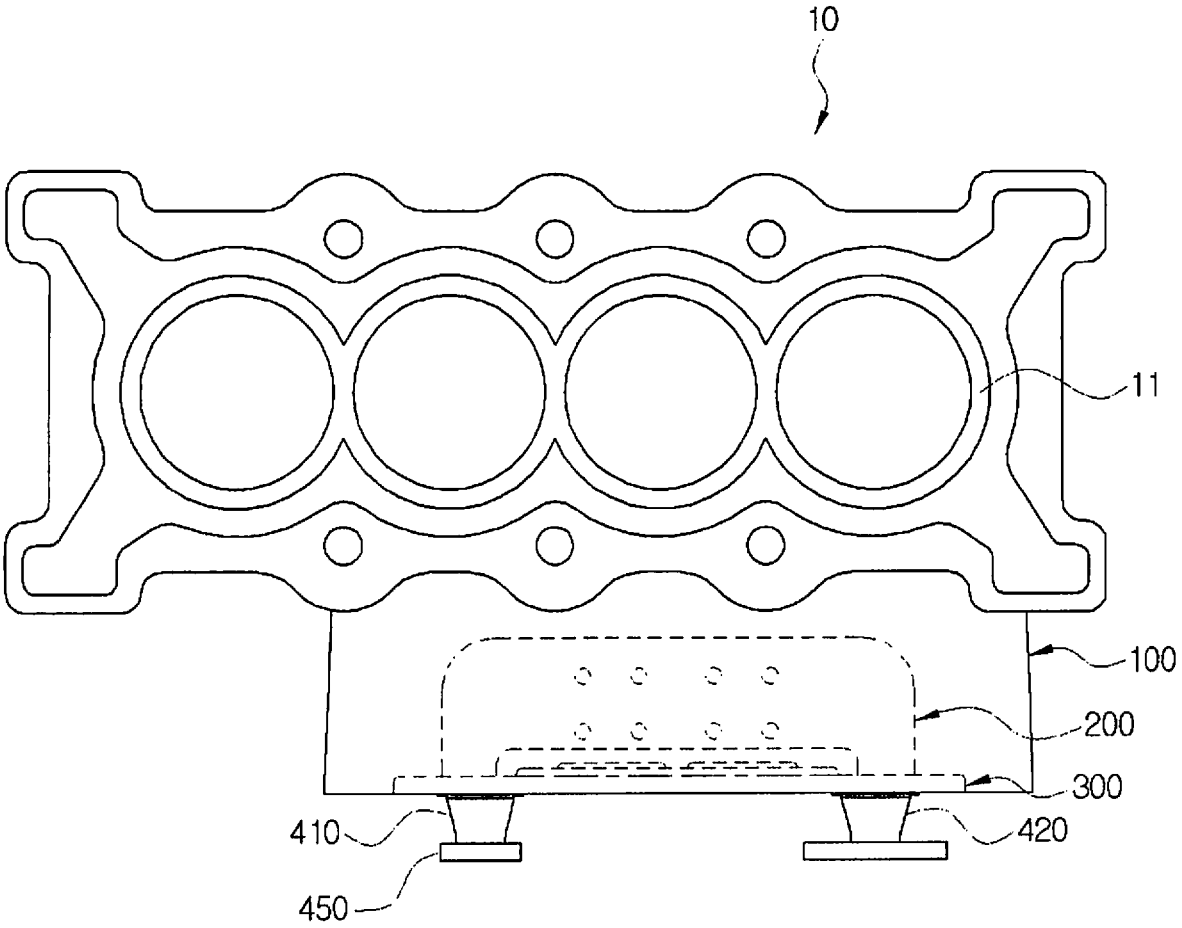
FIG. 1 is a front view illustrating a state in which an exhaust gas cooling apparatus according to a first exemplary embodiment of the present invention is mounted outside an engine cylinder.
Figure 2:
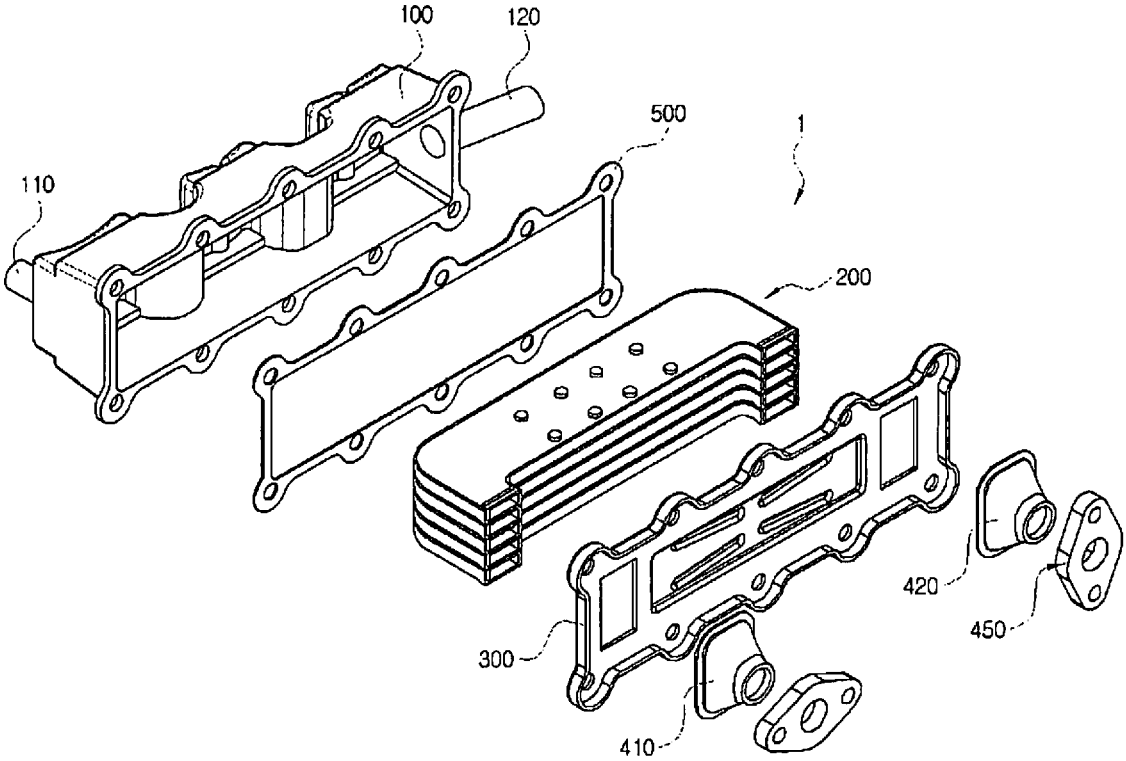
FIG. 2 is an exploded perspective view of the exhaust gas cooling apparatus according to the first exemplary embodiment of the present invention.

As shown in FIGS. 1 and 2, in the exhaust gas cooling apparatus 1 according to the first exemplary embodiment of the present invention, a cooler main body is inserted into an engine block to allow a coolant flowing in the engine block to flow in the exhaust gas cooling apparatus 1, thereby cooling the exhaust gas.

The exhaust gas cooling apparatus 1 according to the present invention may be configured to include a housing 100, a heat exchanger 200, and a main plate 300.

The housing 100 is configured to include a cooling fluid inlet 110 and a cooling fluid outlet 120, and a space in which a cooling fluid introduced through the cooling fluid inlet 110 may be received is formed inside the housing 100. Here, the cooling fluid is generally a coolant, and in addition to the coolant, other cooling fluids may be used.

Here, as shown in FIG. 1, the housing 100 is formed to correspond to an outer wall surface of a cylinder block 10 positioned outside a water jacket 11 of an internal combustion engine mounted in a vehicle, and is disposed to be in contact with the outer wall surface of the cylinder block 10.

The housing 100 may be formed integrally with the engine block, and in this case, as the cooling fluid inlet 110 and the cooling fluid outlet 120 are not separately formed, the manufacturing time and manufacturing cost of the housing 100 of the EGR cooler 1 may be reduced by reducing an assembling process, and a space in which the EGR cooler 1 is installed in an engine room of the vehicle may be minimized.

A plurality of heat exchange tubes 200 in which the exhaust gas flows are disposed to be spaced apart from each other by a predetermined interval in a width direction in the housing 100, and each of the heat exchange tubes 200 is formed to have a height longer than a width.

In addition, the main plate 300 includes a first communication hole 310 to which one end of each of the heat exchange tubes 200 is fixed, and a second communication hole 320 to which the other end of each of the heat exchange tubes 200 is fixed. The first communication hole 310 and the second communication hole 320 are formed to correspond to the number of the plurality of heat exchange tubes 200.

Here, the main plate 300 to which the heat exchange tubes 200 are fixed is mounted in the housing 100, such that the exhaust gas flows through the plurality of heat exchange tubes 200 and the cooling fluid inside the housing 100 flows outside the heat exchange tubes 200 and cools the exhaust gas flowing in the heat exchange tubes 200 through heat exchange. The housing 100 and the main plate 300 may be coupled to each other by bolt coupling.

In addition, a gasket 500 may be installed between the housing 100 and the main plate 300 to prevent the cooling fluid from leaking to the outside of the housing 100 from the housing 100. The gasket 500 may be formed to correspond to a surface where the housing 100 and the main plate 300 meet, and may be coupled to the housing 100 by bolt coupling and may also be coupled to the housing 100 by welding.

Figure 3:
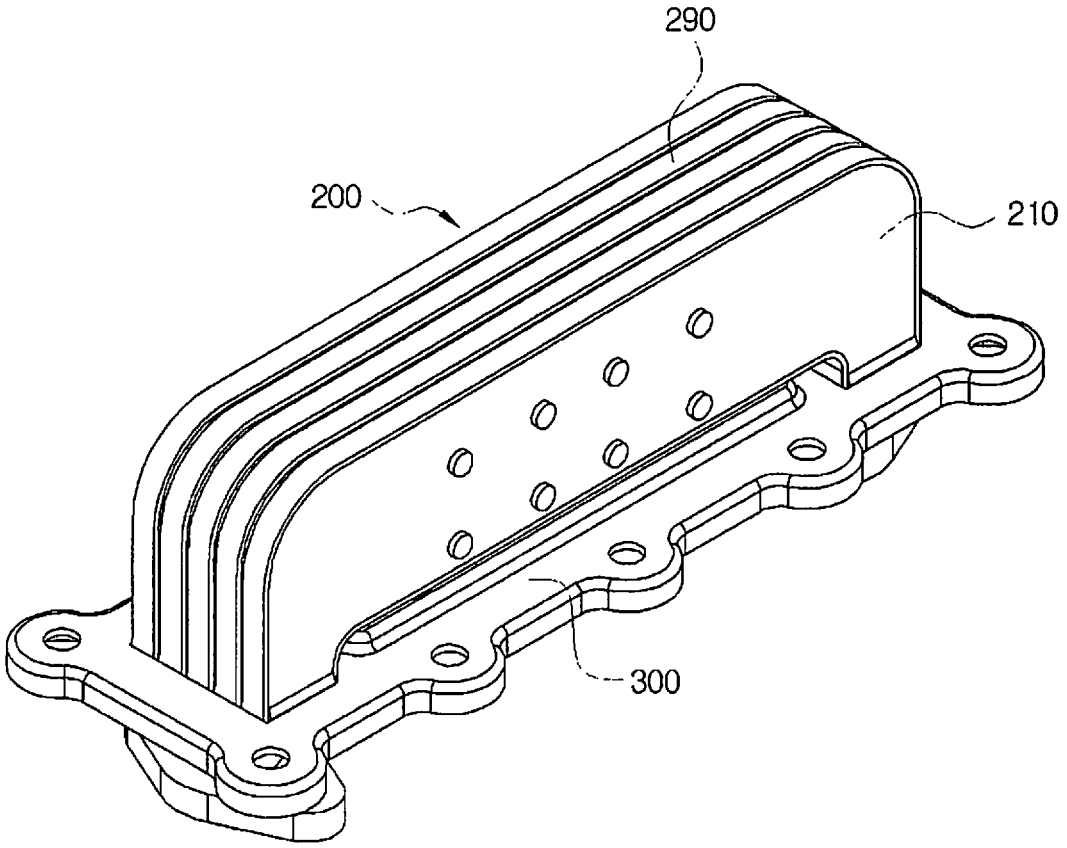
FIG. 3 is a perspective view of the exhaust gas cooling apparatus according to the first exemplary embodiment of the present invention.

As shown in FIGS. 1 to 3, the heat exchange tubes 200 of the exhaust gas cooling apparatus 1 according to the present invention may include a first side surface 210 perpendicular to a width direction; a second side surface 250 having the same shape as the first side surface 210 and disposed to be spaced apart from the first side surface 210 by a predetermined interval; and a connection surface 290 formed by connecting peripheries except for portions contacting the first communication hole 310 and the second communication hole 320 among peripheries of the first side surface 210 and the second side surface 250, in order to form a height to be longer than a width.

That is, the heat exchange tubes 200 have a cross section of a hollow rectangular shape in which a height is longer than a width. Therefore, the heat exchange tubes 200 according to the present invention are not stacked in a height direction, but are stacked in a width direction, and since the cooling fluid flowing from an upper portion of one side of the heat exchange tubes 200 may easily flow between the respective heat exchange tubes 200, thereby reducing flow resistance of the cooling fluid and finally improving heat exchange performance. If the tubes having the height shorter than the width are used unlike the heat exchange tubes 200 according to the present invention, many tubes may not be stacked in the width direction, and therefore, since the cooling fluid flowing from the upper portion of one side of the tubes does not easily flow between the respective tubes and an area that the cooling fluid collide surfaces of the tubes is increased, the flow resistance for the cooling fluid to flow between the tubes becomes large.

Figure 4:
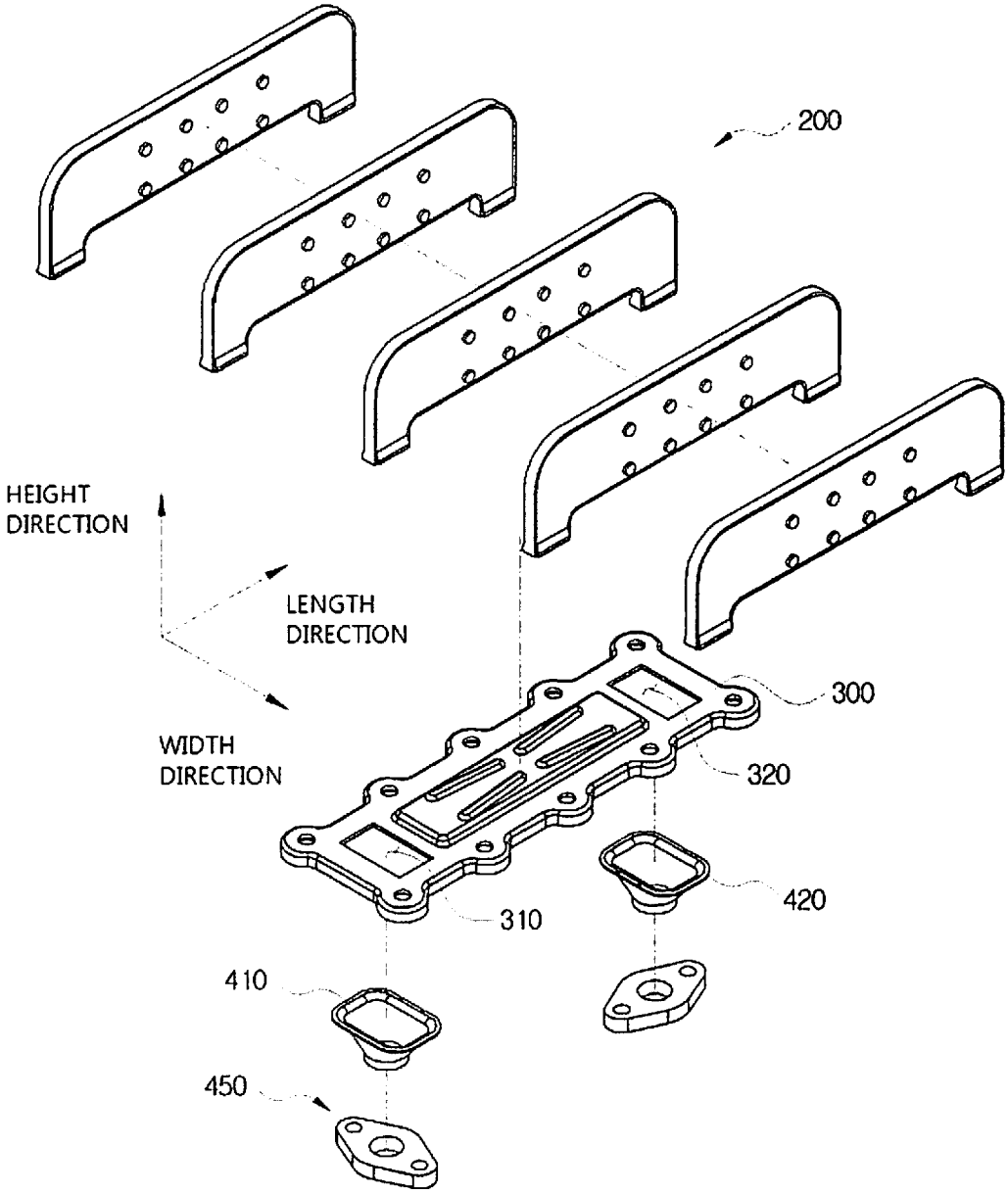
FIG. 4 is an exploded perspective view of the exhaust gas cooling apparatus according to the first exemplary embodiment of the present invention.
Figure 5:
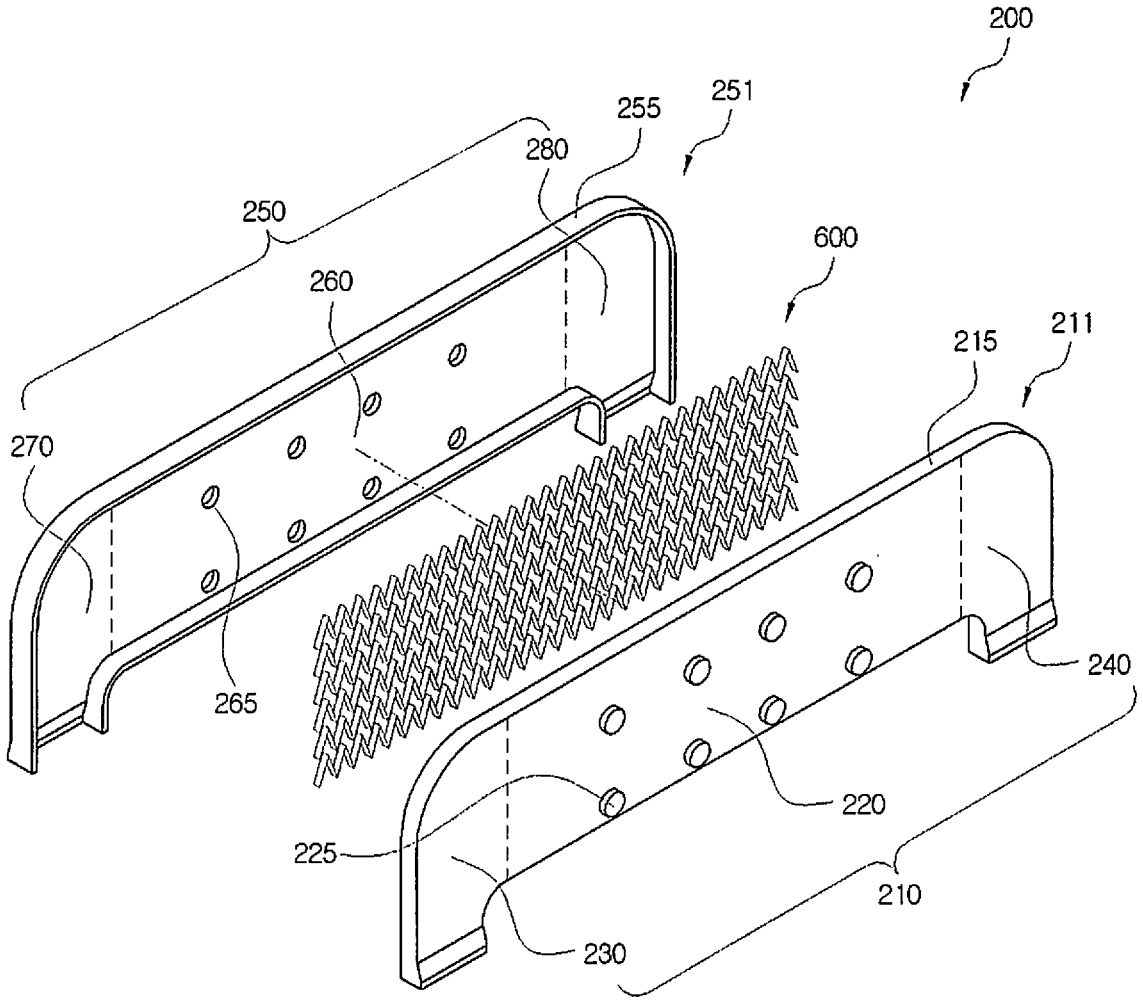
FIG. 5 is an exploded perspective view of a heat exchange tube of the exhaust gas cooling apparatus according to the first exemplary embodiment of the present invention.

The heat exchange tubes 200 having the cross section of the hollow rectangular shape as described above may also be formed as follows. That is, as shown in FIGS. 4 and 5, the heat exchange tube 200 includes a first surface portion 211 including a first bonding portion 215 that protrudes toward the second side surface 250 by a predetermined length in a periphery except for portions inserted into the first communication hole 310 and the second communication hole 320 among the first side surface 210 perpendicular to a width direction and a periphery of the first side surface 210; and a second surface portion 251 including a second bonding portion 255 that protrudes toward the first side surface 210 by a predetermined length in a periphery except for the portions inserted into the first communication hole 310 and the second communication hole 320 among the second side surface 250 perpendicular to the width direction and a periphery of the second side surface 250, wherein a side surface of the second bonding portion 255 and a side surface of the first bonding portion 215 are disposed to be in contact with each other such that an exhaust gas flow path may be formed between the first surface portion 211 and the second surface portion 251.

That is, in the case in which the tube is formed by pressing from both sides, since it is difficult to bend both ends of the tube in order to fix the both ends of the tube to the first communication hole 310 and the second communication hole 320, the heat exchange tube having the height longer than the width according to the present invention has an advantage that it is easily manufactured by forming one heat exchange tube having the height longer than the width by overlapping the first surface portion 211 and the second surface portion 251 of the plate type corresponding to each other.

In addition, when one heat exchange tube 200 is formed by overlapping the first surface portion 211 and the corresponding second surface portion 251, the portions that are in contact with each other are the first bonding portion 215 and the second bonding portion 255. The first bonding portion 215 may be on the outside and vice versa. The first bonding portion 215 and the second bonding portion 255 formed at the peripheries except for the portions inserted into the first communication hole 310 and the second communication hole 320 are bonded to each other, so that the exhaust gas inside the heat exchange tube 200 and the external cooling fluid may flow without leaking to each other. In this case, the bonding may be formed by brazing.

In addition, in order to keep an inner width of the heat exchange tube 200 constant, the first bonding portion 215 or the second bonding portion 255 may protrude as much as a width of the exhaust gas flow path. If the first bonding portion 215 is disposed outside the second bonding portion 255, it is preferable that the second bonding portion 255 protrudes as much as the inner width of the heat exchange tube 200. In this case, the first bonding portion 215 is in contact with the second bonding portion 255 as much as the protruded length, and the first bonding portion 215 may be formed to protrude by a predetermined length to minimize leakage during brazing.

In addition, in order to increase a heat exchange area between the heat exchange tube 200 and the exhaust gas and to improve a heat exchange performance by forming turbulence, a heat radiating fin 600 may be provided between the first side surface 210 and the second side surface 250. In this case, the heat radiating fin 600 may be a wave type shown in FIG. 4, and other forms may also be used to increase the heat exchange area. In this case, the heat radiating fin 600 may also be provided entirely between the first side surface 210 and the second side surface 250, and may also be formed only between a first flat portion 220 and a second flat portion 260, which will be described below, for easiness of manufacturing and assembly. In addition, the heat radiating fin 600 is brazed simultaneously with the first side surface 210 and the second side surface 250 and does not have to undergo a separate step.

The heat exchange tube 200 will be described in detail as follows.

First, the first side surface 210 may be formed to include a first flat portion 220 extending along a length direction; a 1-1-th curve portion 230 extending from one end of the first flat portion 220 to the first communication hole 310; and a 1-2-th curve portion 240 extending from the other end of the first flat portion 220 to the second communication hole 320, and the second side surface 250 may be formed to include a second flat portion 260 extending along the length direction; a 2-1-th curve portion 270 extending from one end of the second flat portion 260 to the first communication hole 310; and a 2-2-th curve portion 280 extending from the other end of the second flat portion 260 to the second communication hole 320.

The first flat portion 220 has a rectangular cross-sectional shape perpendicular to the width direction and extends horizontally along the length direction of the housing 100. The 1-1-th curve portion 230 extends from one end of the first flat portion 220 to the first communication hole 310. Since one end of the first flat portion 220 and the first communication hole 310 are formed perpendicular to each other, the 1-1-th curve portion 230 has a shape bent at 90 degrees to connect the first flat portion 220 and the first communication hole 310 to each other, and when a length of the first communication hole 310 is shorter than a height of the first flat portion 220, the 1-1-th curve portion 230 has a shape in which a length of the 1-1-th curve portion 230 is increased toward one end of the first flat portion 220 from the first communication hole 310. This may be applied to the 1-1-th curve portion 230, the 2-1-th curve portion 270, and the 2-2-th curve portion 280 in the same way. In general, when viewing the first side surface 210 in the height direction, the first side surface 210 and the second side surface 250 may be formed in a "C" shape.

When the exhaust gas flows between the 1-1-th curve portion 230 and the 2-1-th curve portion 270 in an upper direction from lower of one side of the heat exchange tube 200, that is, the first communication hole 310 of the main plate 300 and flows between the first flat portion 220 and the second flat portion 260 by changing the direction in the length direction, side portions of the 1-1-th curve portion 230 and the 2-1-th curve portion 270 in the exhaust gas flow direction may be formed in a rounded shape so as to have a predetermined curvature in order to flow the exhaust gas as smoothly as possible and to reduce the resistance. This may be applied to the 2-1-th curve portion 270 and the 2-2-th curve portion 280 in the same way.

In this case, it is preferable that the length of the first flat portion 220 is longer than the height of the 1-1-th curve portion 230 and the 1-2-th curve portion 240. This may be applied to the second flat portion, the 2-1-th curve portion 270, and the 2-2-th curve portion 280 in the same way. Through this, by minimizing the flow resistance in the 1-1-th curve portion 230 and the 1-2-th curve portion 240 and increasing the length of the first flat portion 220 having good heat exchange performance, it possible to entirely reduce the flow resistance and increase the heat exchange area to maximize the heat exchange performance.

The heat exchange tube 200 of a stacked type plate shape according to the present invention as described above has a conventional gas box, a header, and a heat exchanging portion formed integrally, and is easy to assemble and mass-produce, minimizes the leakage portion, and minimizes the flow resistance, thereby ultimately improving the heat exchange performance.

Meanwhile, the first side surface 210 may include a plurality of first protrusions 225 protruding in a direction opposite to the second side surface 250, and the second side surface 250 may include a plurality of second protrusions 265 protruding in a direction opposite to the first side surface 210.

In this case, the first protrusions 225 and the second protrusions 265 may have various cross-sectional shapes such as a circle, an ellipse, and a square, and may be disposed on the first side surface 210 and the second side surface 250 in a plurality of columns to be spaced apart from each other by a predetermined distance, and may also be disposed in a zigzag manner.

In addition, an end portion of the first protrusion 225 is disposed to be in contact with an end portion of the second protrusion 265 of an adjacent heat exchange tube 200 so that the cooling fluid may flow between the first side surface 210 and the second side surface 250 of the adjacent heat exchange tube 200. That is, since the heat exchange tubes 200 are spaced apart from each other by the protruding length of the first protrusion 225 and the second protrusion 265, the cooling fluid may flow therebetween.

Therefore, the first protrusion 225 and the second protrusion 265 determine a distance between the heat exchange tubes 200 according to the degree of protrusion thereof, and accordingly, the flow resistance of the cooling fluid and the number of the disposed heat exchange tubes 200 may be determined. In addition, the end portions of the first protrusion 225 and the second protrusion 265 are disposed to be in contact with each other and are brazed so that the heat exchange tubes 200 may be formed in the form of one module to facilitate the assembly and mass-production. In addition, the first protrusions 225 and the second protrusions 264 may cause turbulence in the cooling fluid flowing on the outer surface of the heat exchange tube 200, thereby improving the heat exchange performance.

Meanwhile, an end portion of the 1-1-th curve portion 230 which is in contact with the first communication hole 310 may protrude in the same manner as the first protrusion 225, an end portion of the 1-2-th curve portion 240 which is in contact with the first communication hole 310 may protrude in the same manner as the second protrusion 265, an end portion of the 2-1-th curve portion 270 which is in contact with the second communication hole 320 may protrude in the same manner as the first protrusion 225, and an end portion of the 2-2-th curve portion 280 which is in contact with the second communication hole 320 may protrude in the same manner as the second protrusion 265. In this case, the end portion of the 1-1-th curve portion 230 is disposed to be in contact with the end portion of the 2-1-th curve portion 270 of the adjacent heat exchange tube 200 and the end portion of the 1-2-th curve portion 240 is disposed to be in contact with the end portion of the 2-2-th curve portion 280 of the adjacent heat exchange tube 200, such that all the exchange gas may be introduced into the heat exchange tube 200 without leaking to the outside when the exhaust gas is introduced into the heat exchange tube 200 in an upper direction from the first communication hole 310 of the main plate 300.

Thereby, it is not necessary to form a plurality of separate holes for inserting and fixing the heat exchange tubes 200 into and to the main plate 300, as well as not leak the exhaust gas to the outside. In addition, like the first protrusion 225 and the second protrusion 265 as described above, the protruded end portion and an adjacent end portion are disposed to be in contact with each other and are brazed so that the heat exchange tubes 200 may be formed in the form of one module to facilitate the assembly and mass-production.

The plurality of heat exchange tubes 200 including the first surface portion 211 and the second surface portion 251, the heat radiating fin 600, and the main plate 300 may be simultaneously brazed to facilitate the assembly and the mass-production.

Meanwhile, the exhaust gas cooling apparatus according to the present invention may further include an exhaust gas inflow portion 410 having one side coupled to the first communication hole 310 and the other side through which the exhaust gas is introduced; and an exhaust gas outflow portion 420 having one side coupled to the second communication hole 320 and the other side to which the exhaust gas is discharged.

The exhaust gas inflow portion 410 has the other side from which the exhaust gas is introduced and one side coupled to a lower portion of the first communication hole 310 so that the exhaust gas is moved to one side of the exhaust gas inflow portion 410 and enters the heat exchange tubes 200. As shown in FIGS. 1 to 4, the exhaust gas inflow portion 410 is formed so that a cross section of one side thereof into which the exhaust gas is introduced is small and a cross section of the other side to which the exhaust gas is discharged is large to correspond to the first communication hole 310, and a curved surface may be thus formed between the cross section of one side and the cross section of the other side so as to allow the exhaust gas to spread widely. The exhaust gas outflow portion 420 has the other side coupled to a lower portion of the second communication hole 320 so that the exhaust gas is introduced from the heat exchange tubes 200 and is discharged to one side of the exhaust gas outflow portion 420.

In this case, the exhaust gas outflow portion 420 may be formed in the same shape as the exhaust gas inflow portion 410. In addition, an angle may be variously changed depending on an installation direction of an exhaust gas line to which the exhaust gas is introduced.

In addition, a flange 450 may be formed on the other side of the exhaust gas inflow portion 410 and on the other side of the exhaust gas outflow portion 420 so as to be connected to the exhaust gas line.

Meanwhile, the exhaust gas cooling apparatus according to the first exemplary embodiment of the present invention may further include a housing 100 formed to correspond to an outer wall surface of a cylinder block 10 positioned outside a water jacket 11 of an internal combustion engine mounted in a vehicle and disposed on the outer wall surface of the cylinder block 10, and including a cooling fluid inlet 110 and a cooling fluid outlet 120, in addition to the heat exchange tubes 200 and the main plate 300. In this case, the main plate 300 is mounted in the housing 100 to dispose the heat exchange tubes 200 in the housing 100, and the cooling fluid flowing outside the heat exchange tubes 200 and the exhaust gas flowing inside the heat exchange tubes may exchange heat.

Figure 6:
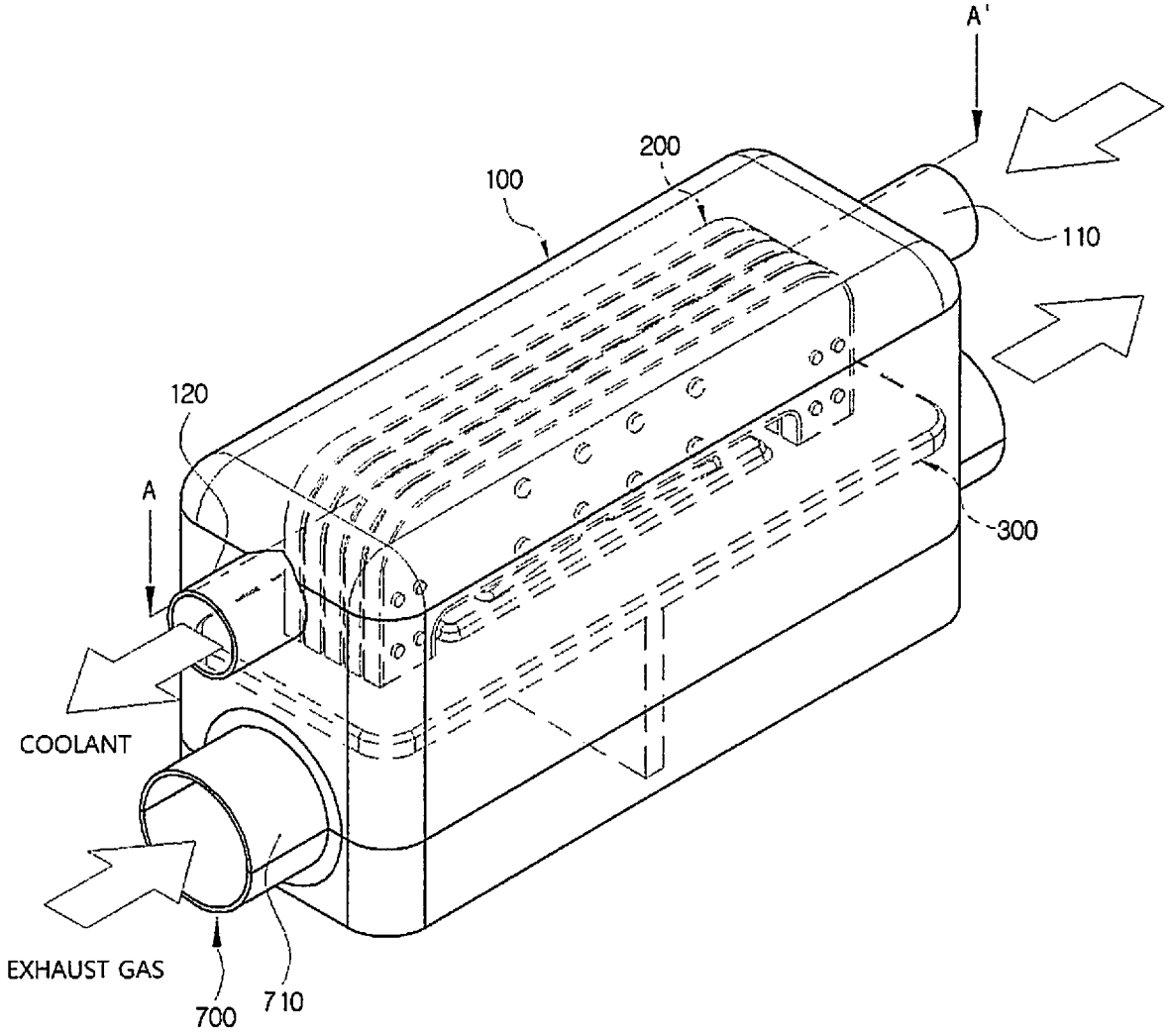
FIG. 6 is a front view illustrating a state in which an exhaust gas cooling apparatus according to a second exemplary embodiment of the present invention is mounted on an exhaust gas discharging line.
Figure 7:
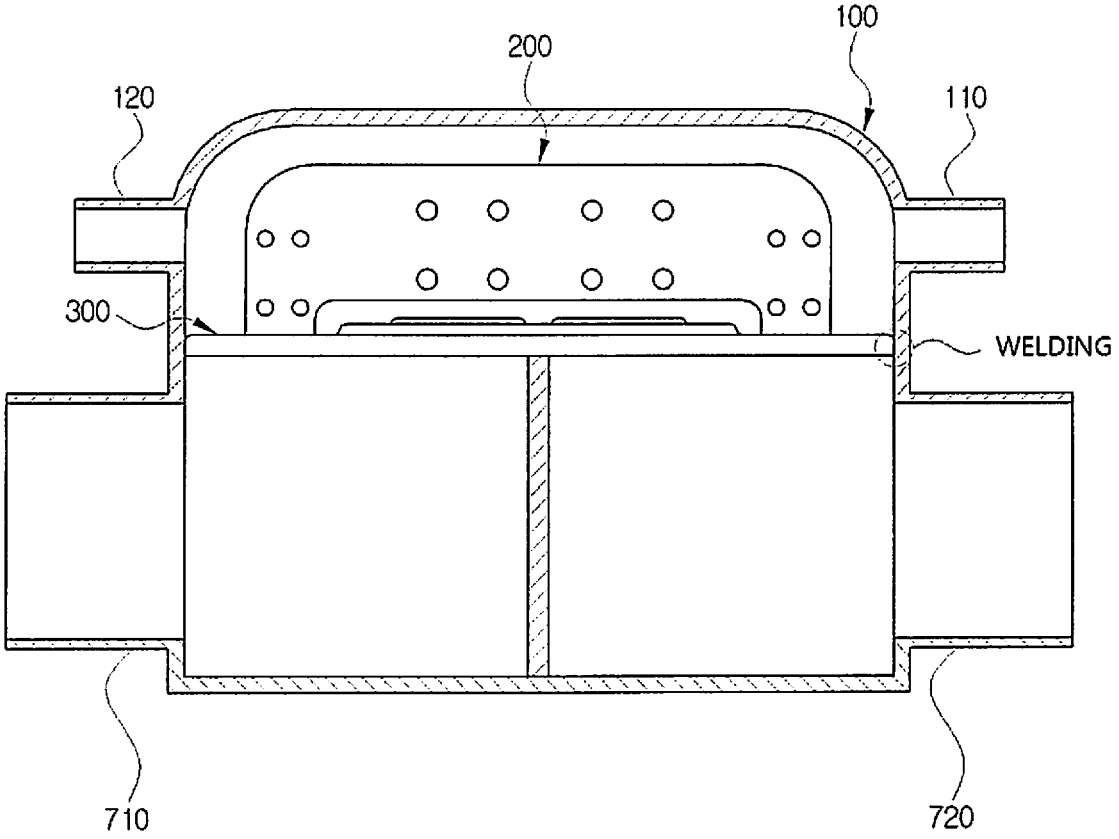
FIG. 7 is a cross-sectional view taken along line A-A' of FIG. 6.

As shown in FIGS. 6 and 7, an exhaust gas cooling apparatus 1 according to a second exemplary embodiment of the present invention is provided on an exhaust gas discharging line 700, and may recover the heat of the exhaust gas introduced from the lower portion of the housing with the cooling fluid introduced from the upper portion of the housing by the heat exchange tubes provided in the housing.

The exhaust gas cooling apparatus 1 according to the present invention may be configured to include a housing 100, a heat exchange tube 200, and a main plate 300.

The housing 100 has the form of a square box with an empty interior, and may include a cooling fluid inlet 110 formed in an upper portion of one side thereof, a cooling fluid outlet 120 formed in an upper portion of the other side thereof, an exhaust gas inlet 710 formed in a lower portion of one side thereof, and an exhaust gas outlet 720 formed in a lower portion of the other side thereof. In this case, a flow direction of the cooling fluid and a flow direction of the exhaust gas may be the same, but are preferably formed opposite to each other.

Since the housing 100 may be provided in the middle of the exhaust gas discharging line 700, it is easy to install the housing 100.

As shown in FIGS. 6 and 7, the main plate 300 to which the heat exchange tubes 200 are fixed is mounted in the housing 100, and a portion above the main plate 300 on which the heat exchange tubes 200 are disposed and a portion below the main plate 300 are divided based on the main plate 300. In this case, a side surface of the main plate 300 and an inner surface of the housing 100 need to be coupled to each other so that the exhaust gas and the cooling fluid do not leak, and may be coupled to each other by welding or brazing.

The cooling fluid introduced through the cooling fluid inlet 110 of the upper portion of the housing 100 flows outside the heat exchange tubes 200 and the exhaust gas introduced through the exhaust gas inlet 710 of the lower portion of the housing 100 passes through the first communication hole 310 of the main plate 300 and flows through the heat exchange tubes 200 so that the exhaust gas and the cooling fluid exchange the heat with each other.

In addition, in order for the exhaust gas introduced through the exhaust gas inlet 710 of the lower portion of the housing 100 to be introduced into the first communication hole 310 of the main plate 300 without falling into the exhaust gas outlet 720 of an opposite side, a blocking wall may be provided on an inner surface of the lower portion of the housing 100 and a lower surface of the main plate 300. Alternatively, a shut-off valve that is opened under a predetermined condition may also be installed.

A plurality of heat exchange tubes 200 in which the exhaust gas flows are disposed to be spaced apart from each other by a predetermined interval in a width direction in the housing 100, and each of the heat exchange tubes 200 is formed to have a height longer than a width.

The heat exchange tubes 200 of the exhaust gas cooling apparatus according to the present invention may have the same characteristics as the heat exchange tubes 200 according to the first exemplary embodiment. Hereinafter, only differences from the heat exchange tubes 200 according to the first exemplary embodiment will be described.

Figure 8:
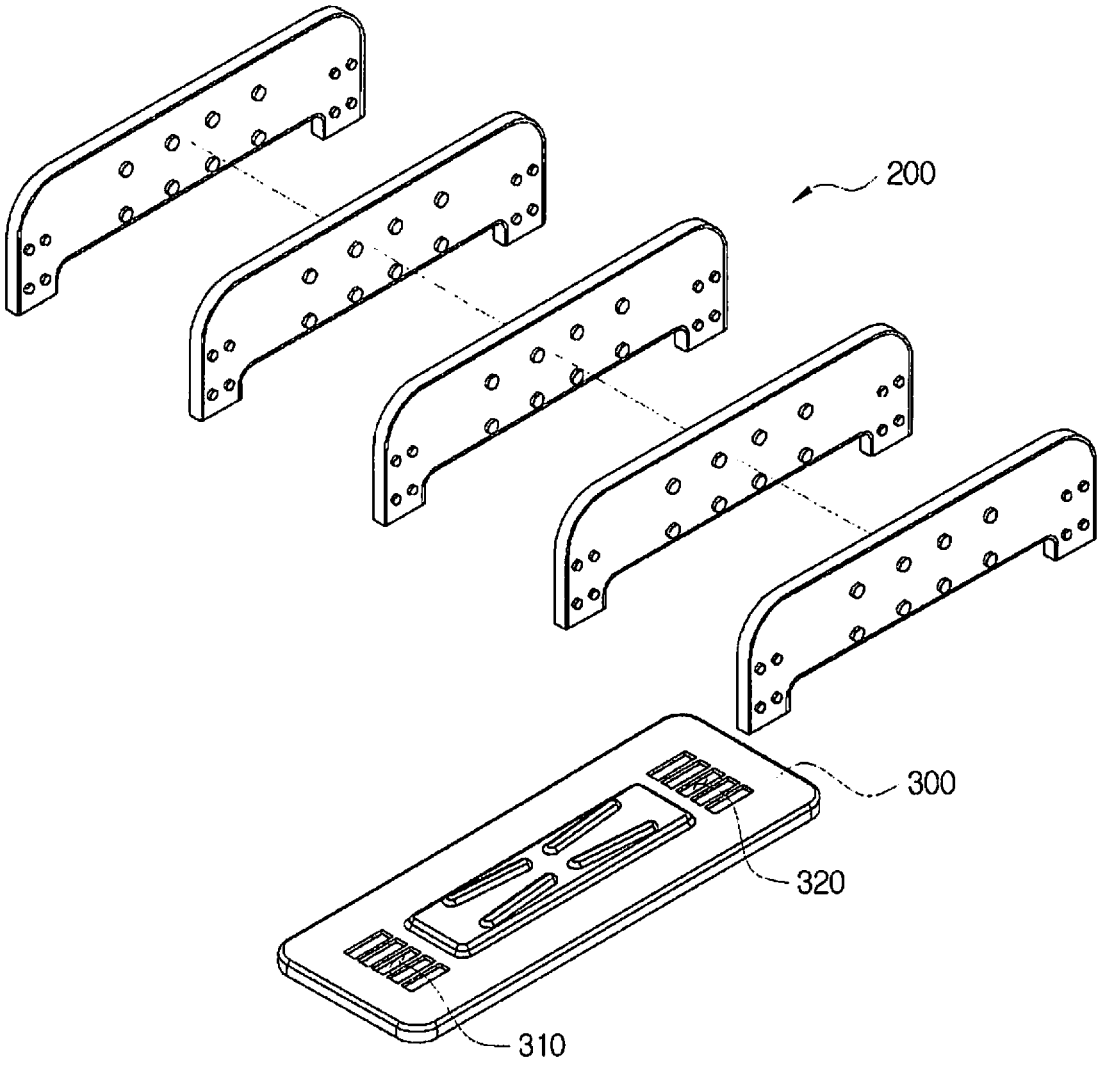
FIG. 8 is an exploded perspective view of the exhaust gas cooling apparatus according to the second exemplary embodiment of the present invention.
Figure 9:
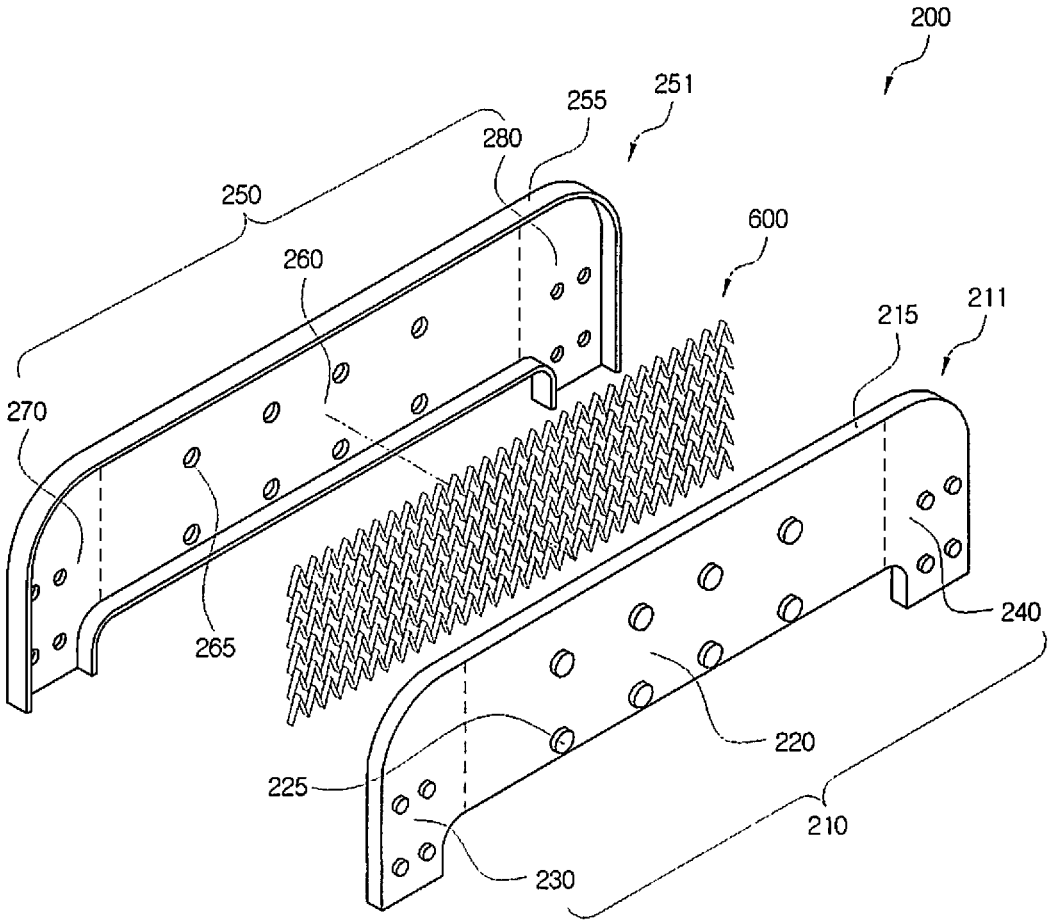
FIG. 9 is an exploded perspective view of a heat exchange tube of the exhaust gas cooling apparatus according to the second exemplary embodiment of the present invention.

As shown in FIGS. 8 and 9, the heat exchange tubes 200 according to the second exemplary embodiment will be described in detail as follows.

The first side surface 210 may include a plurality of first protrusions 225 protruding in a direction opposite to the second side surface 250, and the second side surface 250 may include a plurality of second protrusions 265 protruding in a direction opposite to the first side surface 210.

In this case, the first protrusions 225 and the second protrusions 265 may be formed on the 1-1-th curve portion 230 to the 2-2-th curve portion 280 as well as on the first flat portion 220 and the second flat portion 260. In addition, the first protrusions 225 and the second protrusions 265 may also protrude inwardly from the heat exchange tubes. Thereby, since a flow direction of the exhaust gas is changed in the 1-1-th curve portion 230 to the 2-2-th curve portion 280, the first protrusions 225 and the second protrusions 265 protrude inwardly from the heat exchange tubes and are formed along the flow direction, thereby making it possible to naturally change of the flow direction of the exhaust gas.

Meanwhile, unlike the first exemplary embodiment, in order to reduce the number of processing steps of the heat exchange tubes 200, the end portions of the 1-1-th curve portion 230 to the 2-2-th curve portion 280 that are in contact with the communication holes may not protrude like the protrusions. Instead, as shown in FIG. 8, the first communication hole 310 of the main plate 300 includes a plurality of holes to correspond to the number of the plurality of heat exchange tubes 200, and one end of each of the heat exchange tubes 200 is inserted into and fixed to the corresponding hole, thereby preventing the exhaust gas from leaking. This is applied to the second communication hole 320 in the same way.

Meanwhile, the exhaust gas cooling apparatus according to the second exemplary embodiment of the present invention may further include a housing 100 provided on an exhaust gas discharging line, and including a cooling fluid inlet 110 and a cooling fluid outlet 120 which are formed in an upper portion thereof, and an exhaust gas inlet 710 and an exhaust gas output 720 which are formed in a lower portion thereof. In this case, the main plate 300 is mounted in the housing 100 so that the cooling fluid may flow above the main plate 300 on which the heat exchange tubes 200 are disposed and the exhaust gas may move below the main plate 300.

In the present invention, technical characteristics of the first exemplary embodiment which are not described in the second exemplary embodiment may also be applied to the second exemplary embodiment, and conversely, technical characteristics of the second exemplary embodiment which are not described in the first exemplary embodiment may also be applied to the first exemplary embodiment.

The present invention is not limited to the abovementioned exemplary embodiments, but may be variously applied. In addition, the present invention may be variously modified by those skilled in the art to which the present invention pertains without departing from the gist of the present invention claimed in the claims.

What is claimed is:

1. An exhaust gas cooling apparatus comprising:

a plurality of heat exchange tubes disposed to be spaced apart from each other by a predetermined interval in a width direction, having a height longer than the width, and including an exhaust gas flowing therein; and a main plate including a first communication hole to which one end of each of the heat exchange tubes is fixed and a second communication hole to which the other end of each of the heat exchange tubes is fixed;

wherein the heat exchange tubes includes: a first surface portion including a first bonding portion that protrudes toward a second side surface by a predetermined length in a periphery except for portions inserted into the first communication hole and the second communication hole among a first side surface perpendicular to a width direction and a periphery of the first side surface; and a second surface portion including a second bonding portion that protrudes toward the first side surface by a predetermined length in a periphery except for the portions inserted into the first communication hole and the second communication hole among a second side surface perpendicular to the width direction and a periphery of the second side surface, and a side surface of the second bonding portion and a side surface of the first bonding portion are disposed to be in contact with each other such that an exhaust gas flow path is formed between the first surface portion and the second surface portion, wherein the first side surface includes: a first flat portion extending along a length direction; a 1-1-th curve portion extending from one end of the first flat portion to the first communication hole; and a 1-2-th curve portion extending from the other end of the first flat portion to the second communication hole, and the second side surface includes: a second flat portion extending along the length direction; a 2-1-th curve portion extending from one end of the second flat portion to the first communication hole; and a 2-2-th curve portion extending from the other end of the second flat portion to the second communication hole, wherein the first side surface includes a plurality of first protrusions protruding in a direction opposite to the second side surface, and the second side surface includes a plurality of second protrusions protruding in a direction opposite to the first side surface, such that each end portion of the 1-1-th curve portion and the 2-1-th curve portion of the plurality of heat exchange tubes is connected to one first communication hole, and each end portion of the 1-2-th curve portion and the 2-2 curve portion of the plurality of heat exchange tubes is connected to one second communication hole, wherein the end portion of the 1-1-th curve portion and the end portion of the 1-2-th curve portion protrude in the same manner as the first protrusion, the end portion of the 2-1-th curve portion and the end portion of the 2-2-th curve portion protrude in the same manner as the second protrusion, such that the end portion of the 1-1-th curve portion is disposed to be in contact with the end portion of the 2-1-th curve portion of an adjacent heat exchange tube, and the end portion of the 1-2-th curve portion is disposed to be in contact with the end portion of the 2-2-th curve portion of an adjacent heat exchange tube, wherein the protruding end portions of the 1-1-th, 1-2-th, 2-1-th, and 2-2-th curve portions are formed outside the longitudinal extensions of the first and second flat portions, and wherein the cooling fluid flows outside the heat exchange tubes between the heat exchange tubes along the length direction of the heat exchange tubes.

2. The exhaust gas cooling apparatus of claim 1, wherein the heat exchange tubes include:

a first side surface perpendicular to a width direction;

a second side surface having the same shape as the first side surface and disposed to be spaced apart from the first side surface by a predetermined interval; and a connection surface formed by connecting peripheries except for portions contacting the first communication hole and the second communication hole among peripheries of the first side surface and the second side surface.

3. The exhaust gas cooling apparatus of claim 2, wherein an end portion of the first protrusion is disposed to be in contact with an end portion of the second protrusion of an adjacent heat exchange tube so that the cooling fluid flows between the first side surface and the second side surface of the adjacent heat exchange tube.

4. The exhaust gas cooling apparatus of claim 2, wherein the first bonding portion or the second bonding portion protrudes as much as a width of an exhaust gas flow path.

5. The exhaust gas cooling apparatus of claim 1, wherein the first communication hole includes a plurality of holes to which one end of each of the heat exchange tubes is inserted and fixed, and the second communication hole includes a plurality of holes to which the other end of each of the heat exchange tubes is inserted and fixed.

6. The exhaust gas cooling apparatus of claim 1, wherein a heat radiating fin is provided between the first side surface and the second side surface.

7. The exhaust gas cooling apparatus of claim 1, further comprising:

an exhaust gas inflow portion having one side coupled to the first communication hole and the other side through which the exhaust gas is introduced; and an exhaust gas outflow portion having one side coupled to the second communication hole and the other side to which the exhaust gas is discharged.

8. The exhaust gas cooling apparatus of claim 1, further comprising a housing provided on an exhaust gas discharging line, and including a cooling fluid inlet and a cooling fluid outlet which are formed in an upper portion of the housing, and an exhaust gas inlet and an exhaust gas outlet which are formed in a lower portion of the housing, wherein the main plate is mounted in the housing so that the cooling fluid flows above the main plate on which the heat exchange tubes are disposed and the exhaust gas flows below the main plate.

* * * * *